US006230525B1

(12) United States Patent
Dunlap

(10) Patent No.: US 6,230,525 B1
(45) Date of Patent: May 15, 2001

(54) SOCK WITH IMPACT ABSORBING SOLE AND METHOD

(76) Inventor: Albert Ray Dunlap, 1022 Davis La., Graham, NC (US) 27253

( * ) Notice: Subject to any disclaimer, the term of this patent is extended or adjusted under 35 U.S.C. 154(b) by 0 days.

(21) Appl. No.: 09/564,028

(22) Filed: May 4, 2000

(51) Int. Cl.[7] ..... D04B 1/02
(52) U.S. Cl. ..... 66/182; 66/185; 66/178 R
(58) Field of Search ..... 66/178 R, 179, 66/182, 183, 184, 185, 186, 187, 194, 49; 2/239, 241

(56) References Cited

U.S. PATENT DOCUMENTS 3,793,851 * 2/1974 Thorneburg ..... 66/185
3,828,585 * 8/1974 Thorneburg ..... 66/136
4,172,370 10/1979 Safrit et al. .
4,422,307 * 12/1983 Thorneburg ..... 66/172 E
4,520,635 * 6/1985 Shields et al. ..... 66/185
4,732,015 * 3/1988 Abrams et al. ..... 66/172 E
5,095,548 * 3/1992 Chesebro, Jr. ..... 2/239
5,131,099 7/1992 Zellweger .
5,307,522 * 5/1994 Throneburg et al. ..... 2/239
5,335,517 * 8/1994 Throneburg et al. ..... 66/185
5,603,232 * 2/1997 Throneburg ..... 66/185

* cited by examiner

*Primary Examiner*—Danny Worrell

(57) ABSTRACT

A sock knit on a circular knitting machine is provided in which the sole has increased comfort, impact absorption and abrasion resistance. The sock is knit utilizing conventional yarns and a certain restricted elongation covered elastomeric yarn. The elastomeric yarn is only knit into the sole utilizing a high splice finger during the sole formation.

20 Claims, 4 Drawing Sheets

SOCK WITH IMPACT ABSORBING SOLE AND METHOD

FIELD OF THE INVENTION

The invention herein pertains to knit socks and particularly pertains to socks having a thick or impact absorbing sole as made on a circular knitting machine.

DESCRIPTION OF THE PRIOR ART AND OBJECTIVES OF THE INVENTION

Socks are conventionally made on circular knitting machines and in recent years athletic and other socks have been developed with reinforced soles. Certain of the socks so produced utilize the high splice finger on the knitting machine to knit in a third yarn in the sole area. The high slice finger allows a yarn to be inserted only while the sole is being knit. The yarn so utilized is severed at the termination of the sole knitting cycle and is again fed by the high splice finger during the next needle cylinder revolution as the sole is again being knitted. Socks of this type generally provide a terry or high loop stitch in the sole for added comfort. Elastomeric yarns are traditionally not employed in the sole. While such prior art socks do provide a measure of impact absorption, such do not provide the impact absorption desired and do not have the abrasion resistance to constantly withstand the intensive rigors occurring during athletic contests and other high impact activities.

Thus, with the problems and disadvantages of prior socks, the present invention was conceived and one of its objectives is to provide a sock which can be knit on a circular knitting machine with improved comfort, wear and abrasion resistance.

It is still another objective of the present invention to provide a sock which includes an elastomeric yarn knit into the sole.

It is still another objective of the present invention to provide a sock utilizing a covered elastomeric yarn in the sole having restricted elongation properties.

It is still another objective of the present invention to provide a sock which includes a terry stitch in the sole.

It is a further objective of the present invention to provide a circular knit sock which is formed from a trio of yarns in which an elastomeric yarn is knit into the sole using a high splice finger of the knitting machine.

Various other objectives and advantages of the present invention will become apparent to those skilled in the art as a more detailed description is set forth below.

SUMMARY OF THE INVENTION

The aforesaid and other objectives are realized by forming a sock having an impact absorbing sole on a circular knitting machine utilizing an elastomeric yarn. The elastomeric yarn is knit into the sole with a high splice feed finger of the knitting machine. The elastomeric yarn comprises a covered elastomeric yarn in which the elongation has been restricted to about 100%.

The sock formed by the method described above includes an improved sole having a terry loop construction and exhibits superior impact absorption and abrasion resistance. The sock can be made on a conventional eighty-four needle circular knitting machine having a cylinder diameter of five inches (12.7 cm) such as originally manufactured by H. E. Crawford Company of Kernersville, N.C.

The covered elastomeric yarn is formed with a restricted elongation of about 100%, much less than the conventional elongation of about 260% of standard covered elastomeric yarns as are used in knitting socks.

DETAILED DESCRIPTION OF THE PREFERRED EMBODIMENTS AND OPERATION OF THE INVENTION

Figure 1:
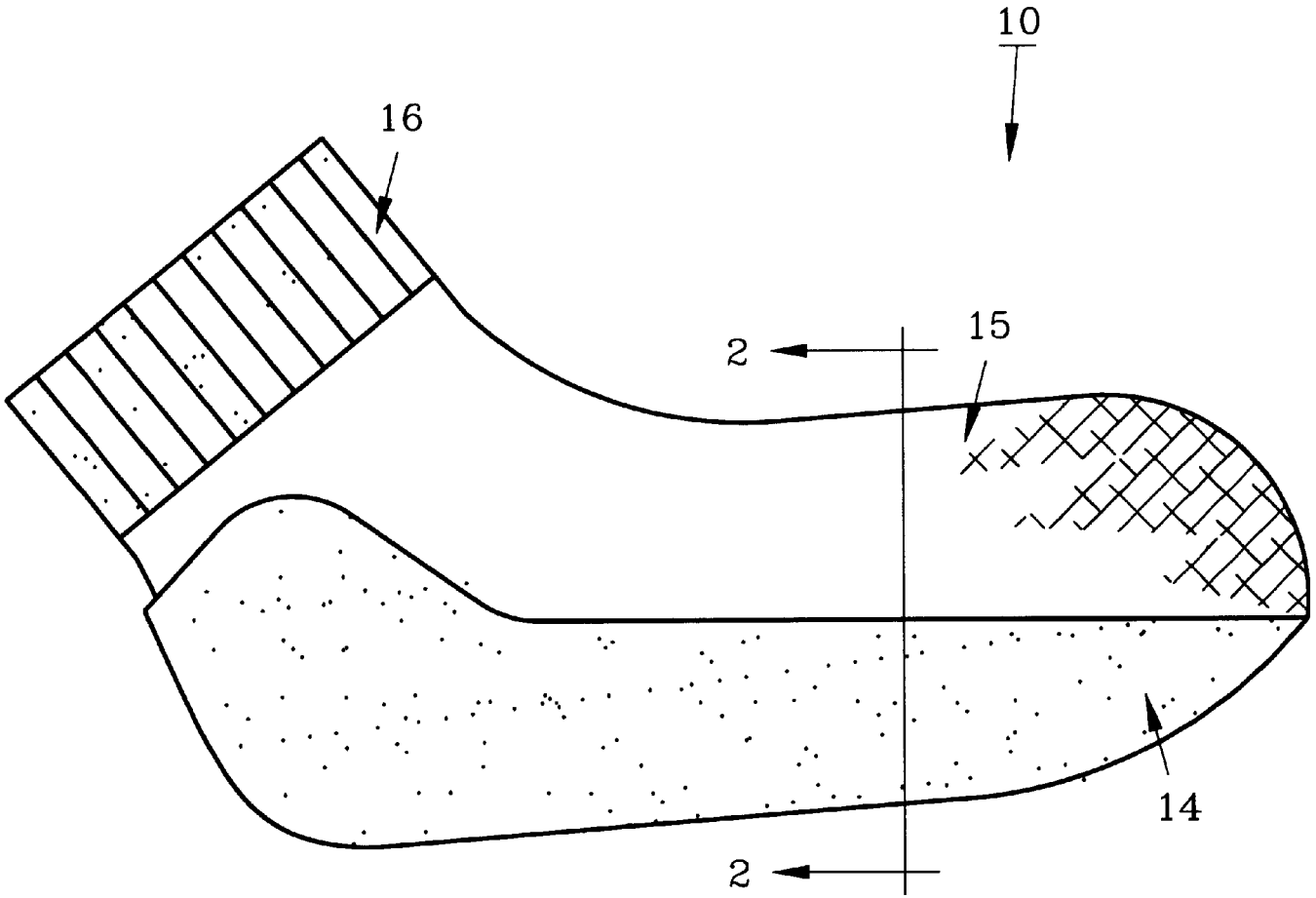
FIG. 1 demonstrates a side elevational view of a sock having the sole with the high impact absorption as herein described.
Figure 3:
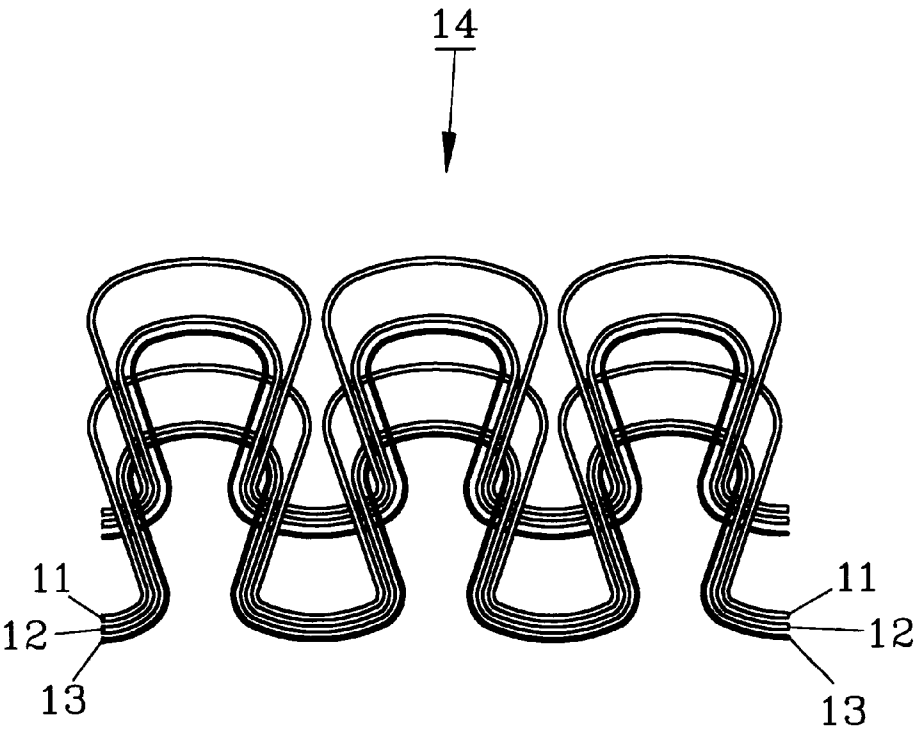
FIG. 3 features in a schematic representation of the knit loop formation in the impact absorbing sole area.

For a better understanding of the invention and its operation, turning now to the drawings, preferred sock 10 is illustrated in FIG. 1 which has been knit on a standard eighty-four needle circular knitting machine utilizing high splice feed finger 26 (FIG. 4) for knitting covered elastomeric yarn 12 into sole 14 as seen in FIG. 3. Preferred covered elastomeric yarn 12 consists of Dorcastan* 840 V800 yarn (*Trademark of Bayer Aktiengesellschaft of Leverkusen, Germany) having a core of 840 V800 elastic yarn covered with 2/70/34 stretch nylon yarn specially manufactured to provide a restricted elongation of 100%. Other suitable elastomeric or rubber yarns could also be used as made by other manufacturers.

Yarn 11 as shown in FIG. 3 consists of one end of six count, one ply cotton whereas yarn 13 consists of two ply, one hundred denier stretch nylon. The top of the sock shown generally at 15 in FIG. 1 is formed from cotton yarn 11 and nylon yarn 13 as used in the sole, utilizing flat stitches, but does not include the covered elastomeric yarn 12. The welt area generally shown at 16 in FIG. 1 is formed from two ends of two ply, one hundred denier stretch nylon having thirty-four filaments and one end of six count, one ply cotton. As shown in FIG. 1, top 15 and welt area 16 are conventional as standard in the industry. The sock thus formed has improved comfort, impact absorption and abrasion resistance due to sole 14 knit as described above.

In order to demonstrate the improved qualities of sock 10, various commercially available socks were tested by taking a specimen from the sole thereof utilizing standard non-elastomeric yarns. The comparison results are as follows:

| Conventional Reinforced high splice fabric sole | Number of Cycles At Failure |
|---|---|
| Test 1: | 980 |
| Test 2: | 1010 |
| Test 3: | 960 |
| | Average 983 |

A specimen was taken from sock 10 and the number of cycles at failure was presented as below:

| Sock 10 | Number of Cycles At Failure |
|---|---|
| Test 1: | 2240 |
| Test 2: | 2500 |
| Test 3: | 2500 |
| | Average 2413 |

As shown, the results denote a difference in the failure percentage of 245% between sock 10 as shown in FIG. 1 and various commercially available socks.

Figure 2:
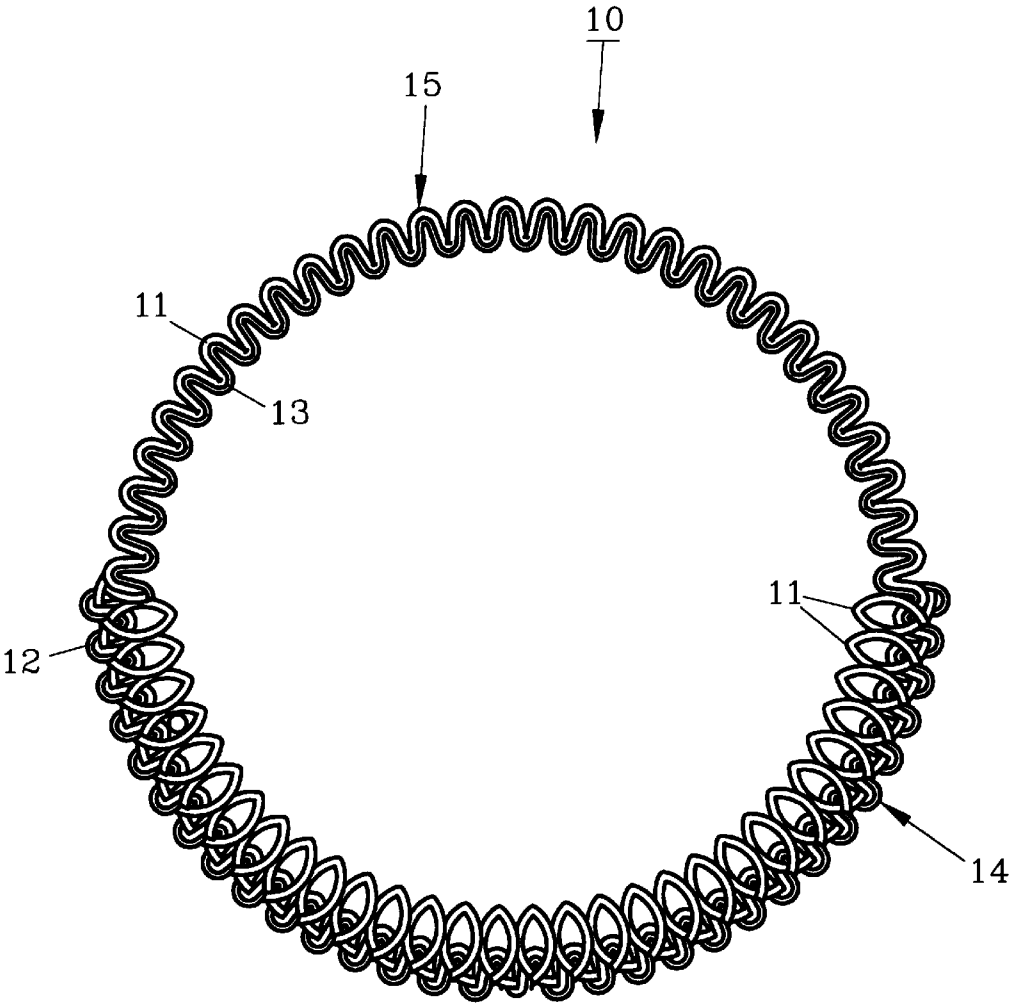
FIG. 2 illustrates a schematic representation of the sock as shown along lines 2—2 of FIG. 1.
Figure 4:
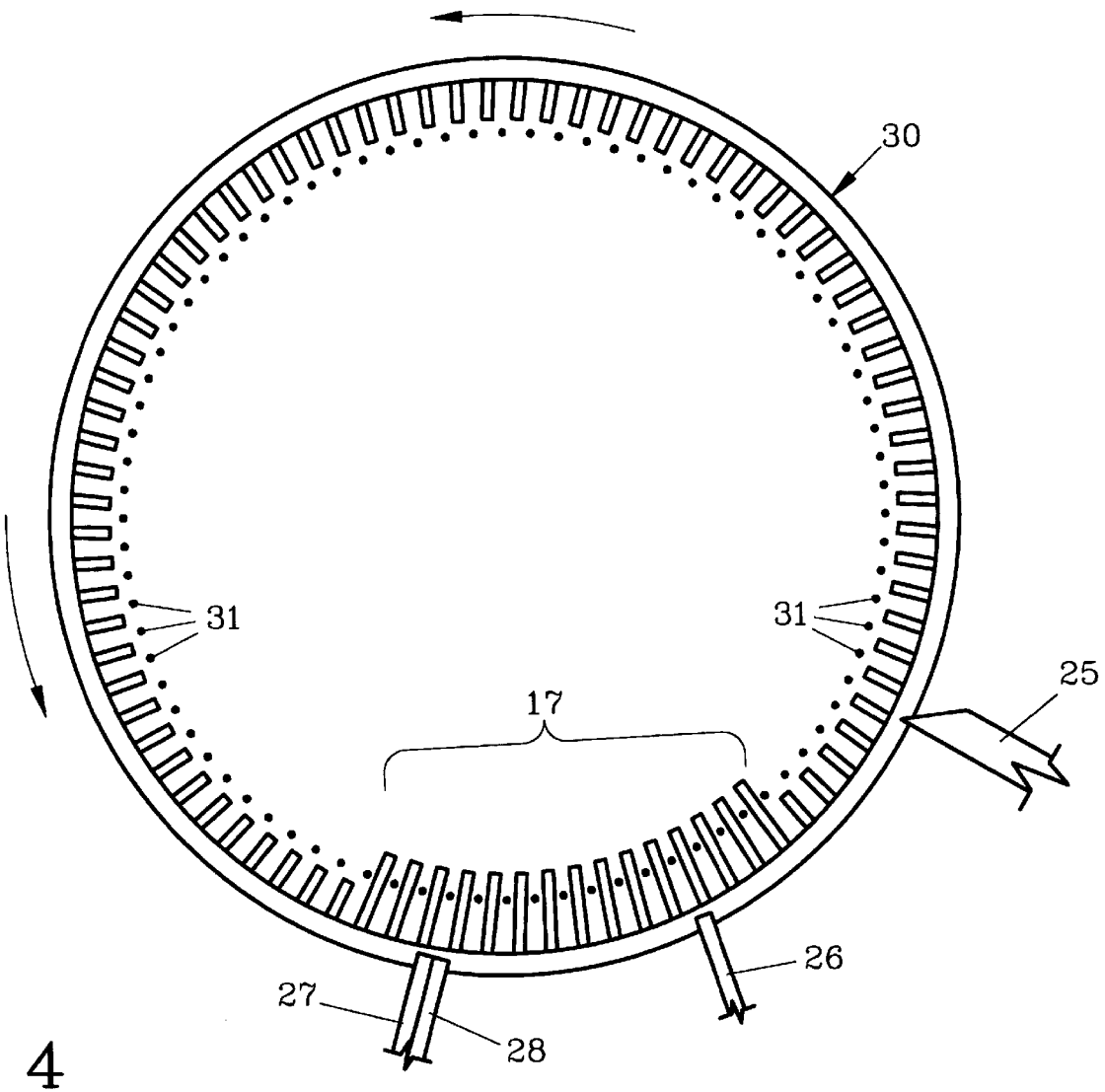
FIG. 4 depicts a schematic representation of certain of the knitting machine cylinder components and related parts.

The preferred method of knitting sock 10 is generally described as follows:

A conventional eighty-four needle circular knitting machine such as a Concept model manufactured by H. E. Crawford Company having a high splice feed finger and utilizing a single yarn feed is provided. As seen in FIG. 4, needle cylinder 30 with needles 31 rotates at about 300 rpm and one course is knit with each rotation of needle cylinder 30. The circular knitting machine (not seen) is adjusted to knit cotton yarn 11 from feed finger 27 in a terry stitch in the sole and to plait nylon yarn 13 from feed finger 28 therein. Covered elastomeric yarn 12 as previously described is knit into the sole only as schematically seen in FIG. 2, utilizing high splice feed finger 26 seen in FIG. 4 in yarn feed area, generally seen at 17. Once elastomeric yarn 12 is knit into sole 14, elastomeric yarn 12 is severed such as by knife 25 while elastomeric yarn 12 is under vacuum pressure as is conventional. Upon severance, elastomeric yarn 12 "snaps-back", but due to its restricted elongation, it does not escape from the last terry stitch. Top 15 is then knit as usual during the continuing cycle of needle cylinder 30 and as top 15 is knit high splice feed finger 26 also shown in FIG. 4 is generally inactive until the knitting of sole 14 again resumes. At that time, high splice feed finger 26 again knits in covered elastomeric yarn 12 which again is severed by knife 25 at the conclusion of the knitting of sole 14 during that cylinder 30 revolution.

In order to allow high splice feed finger 26 to properly knit in elastomeric yarn 12, the elongation of yarn 12 had to be restricted to prevent an excess "snap-back" when knife 25 severs yarn 12. It was found that a restricted elongation range of about 80–120% would work satisfactorily with 100% elongation being preferred.

Various other yarns, sock construction and designs can be utilized employing the disclosed invention and the illustrations and examples provided herein are for explanatory purposes and are not intended to limit the scope of the appended claims.

I claim:

1. A method for forming a sock with an impact absorbing sole on a circular knitting machine having a high splice feed finger comprising the steps of:

a. selecting a first and a second non-elastomeric yarn;

b. selecting an elastomeric yarn;

c. knitting the sole by forming a terry loop with the first non-elastomeric yarn;

d. forming a stitch loop with the second non-elastomeric yarn;

e. knitting an elastomeric yarn into the sole utilizing a high splice feed finger;

f. terminating the knitting of the elastomeric yarn by severing the elastomeric yarn; and thereafter g. continuing knitting to form the top of the sock utilizing the first and second non-elastomeric yarns.

2. The method of claim 1 wherein selecting a first and a second non-elastomeric yarn comprises the step of selecting a cotton and a nylon yarn respectively.

3. The method of claim 1 wherein selecting an elastomeric yarn comprises the step of selecting a restrictive elongation elastic yarn covered with nylon.

4. The method of claim 3 wherein selecting an elastomeric yarn comprises the step of selecting a yarn having a restrictive elongation percentage of between 80–120%.

5. The method of claim 3 wherein selecting an elastomeric yarn comprises the step of selecting a yarn having a restrictive elongation percentage of approximately 100%.

6. The method of claim 1 further comprising the step of severing the elastomeric yarn at the termination of knitting the elastomeric yarn during each cylinder revolution.

7. The method of claim 6 further comprising the step of retaining the elastomeric yarn by vacuum pressure after severing the same.

8. A method for forming an impact absorbing sole for a sock, utilizing a circular knitting machine having a high splice feed finger, consisting of the steps of:

a. selecting a first and a second non-elastomeric yarn;

b. selecting an elastomeric yarn;

c. knitting the sole by forming a terry loop with the first non-elastomeric yarn;

d. forming a stitch loop with the second non-elastomeric yarn;

e. knitting an elastomeric yarn into the sole utilizing a high splice feed finger;

f. terminating the knitting of the elastomeric yarn by severing the elastomeric yarn; and thereafter g. continuing knitting to form the top of the sock utilizing the first and second non-elastomeric yarns.

9. The method of claim 8 wherein selecting a first and a second non-elastomeric yarn consists of the step of selecting a cotton and a nylon yarn respectively.

10. The method of claim 8 wherein selecting an elastomeric yarn consists of the step of selecting a restrictive elongation elastic yarn covered with nylon.

11. The method of claim 8 wherein selecting an elastomeric yarn consists of the step of selecting a yarn having a restrictive elongation percentage of between 80–120%.

12. The method of claim 8 wherein selecting an elastomeric yarn consists of the step of selecting a yarn having a restrictive elongation of approximately 100%.

13. The method of claim 8 wherein terminating the knitting of the elastomeric yarn consists of the step of severing the elastomeric yarn at the termination of knitting the elastomeric yarn during each cylinder revolution.

14. A sock formed on a circular knitting needle comprising: a top, a high impact absorbing sole, said top joined to said sole, a. said top consisting only of knitted non-elastomeric yarns; and b. said sole comprising: a first non-elastomeric yarn, a second non-elastomeric and a third elastomeric yarn having a restricted elongation, said first, second and third sole yarns being knitted therein.

15. The sock of claim 14 wherein said first non-elastomeric yarn of said sole comprises cotton.

16. The sock of claim 14 wherein said second non-elastomeric yarn of said sole comprises nylon.

17. The sock of claim 14 wherein said elastomeric yarn comprises a covered elastomeric yarn.

18. The sock of claim 17 wherein said elastomeric yarn is covered with a stretchable nylon yarn.

19. The sock of claim 17 wherein said covered elastomeric yarn comprises a restrictive elongation percentage of between 80–120%.

20. The sock of claim 18 wherein said elastomeric yarn will elongate approximately 100%.

* * * * *